United States Patent [19]

Pastore

[11] 4,155,484

[45] May 22, 1979

[54] NAPKIN HOLDER AND DISPENSER

[75] Inventor: Ronald Pastore, Bedford, N.Y.

[73] Assignee: Cal Pak Industries, Inc., Stanford, Conn.

[21] Appl. No.: 839,166

[22] Filed: Oct. 4, 1977

[51] Int. Cl.[2] ..... B65H 1/12; A47K 10/42

[52] U.S. Cl. ..... 221/35; 221/58; 312/61

[58] Field of Search ..... 221/35, 52, 58, 59, 221/60, 279, 280; 312/61, 71; 220/93; 206/45, 16

[56] References Cited

U.S. PATENT DOCUMENTS

| | | | |
|---|---|---|---|
| 1,863,240 | 6/1932 | Daniels | 221/58 |
| 2,027,669 | 1/1936 | Broeren | 221/60 X |
| 2,138,692 | 11/1938 | Broeren et al. | 221/35 |
| 2,434,206 | 1/1948 | Frieders | 221/35 |
| 3,121,510 | 2/1964 | Holznarth et al. | 221/60 |

*Primary Examiner*—Robert J. Spar
*Assistant Examiner*—Francis J. Bartuska
*Attorney, Agent, or Firm*—Arthur L. Plevy

[57] ABSTRACT

A napkin dispenser is fabricated from plastic by means of conventional injection molding or other techniques. The dispenser comprises a first and second housing sections which are pivotally coupled by means of a hinge member partially formed on the bottom surface of each housing. Each section contains a napkin accommodating hollow which interfaces with a dispensing aperture on a front wall of the housing. Located between the napkin accommodating hollow and the bottom wall of the housing is a cantilever platform which has first and second recesses. The recesses of one housing are offset with respect to recesses contained in the associated housing on a similar platform. A first plastic spring member has two arcuate arms which are secured within recesses of one housing. A second plastic spring member of a similar configuration has two respective arms which are associated with the recesses in the other housing. When the spring members are secured within the recesses, the arms of each member are adjacent one another to allow movement of the spring members in a direction to urge the respective napkin stacks located in the hollows of the housing towards the dispensing aperture in a closed position. In an opened position, the spring members are urged together to allow one to insert a stack of napkins when the same has been depleted during ordinary use.

9 Claims, 9 Drawing Figures

HEIGHT
WIDTH
LENGTH

NAPKIN HOLDER AND DISPENSER

BACKGROUND OF INVENTION

This invention relates in general to a device for holding and dispensing napkins and more particularly to a napkin dispenser which is durable and economical.

The prior art is replete with a plurality of devices which essentially operate to hold and dispense paper items of all sorts and all types, including napkins. In fact, the prior art contains numerous patents regarding such devices which may be found in Class 206, subclasses 45.15, 45.16, 45.13, 45.2 and in Class 221, subclasses 59, 255, 279, 56 and 58 and in Class 312, subclasses 61 and 71.

Essentially, an extremely popular device for dispensing napkins has been widely distributed and sold in this country under the trademark COMPACT and is manufactured by Marathon Products, a Division of American Can Company and which is distributed as Model No. H-1450. The product is an extremely successful product and is used in restaurants, hotels and households throughout the world. This product, based on its design and appearance, has acheived widespread use and success and is basically described in U.S. Pat. No. 2,434,206.

In any event, many such dispensers including the one described above are fabricated from metal and as such, after prolonged use and based on the environment in which they are used, will rust and present other sanitary problems which are inherent in the use of metal construction.

It is of course, apparent that apart from these factors is the further factor that such metal dispensers require greater time in fabrication in regard to the use of separate parts and separate screws, bolts and rivets in order to attach the various mechanisms together in regard to a common housing. It is thus apparent that many such dispensers are relatively expensive due to the use of metal parts which involve time consuming fabrication procedures employing relatively complicated mechanical structures.

It is therefore an object of the present invention to provide an improved dispenser for napkins; which dispenser is fabricated entirely from plastic and as such, can be integrally molded and fabricated, thus avoiding the use of many mechanical parts and interconnections.

It is a further object of the invention to provide a plastic dispenser employing a secure latch to effectively couple the respective sections of the dispenser together during normal operation.

Other objects of the present invention will become apparent upon reading the following specification and referring to the accompanying drawings which form a part of this disclosure.

BRIEF DESCRIPTION OF PREFERRED EMBODIMENT

In a napkin dispenser apparatus of the type including a first and a second hollow housing, each having a front wall containing an aperture for accessing a stack of napkins associated and contained within said hollow of each housing, said front wall surrounded by two side walls and a top and a bottom wall with an opened rear surface, said first and second housings pivotally coupled at said bottom walls with said opened end surfaces facing each other, the improvement therein comprising a first cantilever platform located a predetermined distance from said bottom wall of said first housing and horizontally disposed between said side walls of said first housing, a second cantilever platform located said predetermined distance from said bottom wall of said second housing and horizontally disposed between said side wall of said second housing, a first arcuate spring member secured to said first platform and positioned to extend into said second housing to exert a force on said stack of napkins associated with said second housing, a second arcuate spring member secured to said second platform and positioned to extend into said first housing to exert a force on said stack of napkins associated with said first housing, with each of said cantilever platforms capable of deflecting to aid in maintaining said force as exerted by said spring members.

BRIEF DESCRIPTION OF FIGURES

FIG. 5 is a top perspective view of a napkin dispenser in a partially opened position.

FIG. 7 is a partial sectional view depicting the nature of a latching mechanism according to this invention.

FIG. 7A is a front view of the latching mechanism associated with one section of the housing, while FIG. 7B is a side view of the latching mechanism.

DETAILED DESCRIPTION OF DRAWINGS

Figures 1, 6:
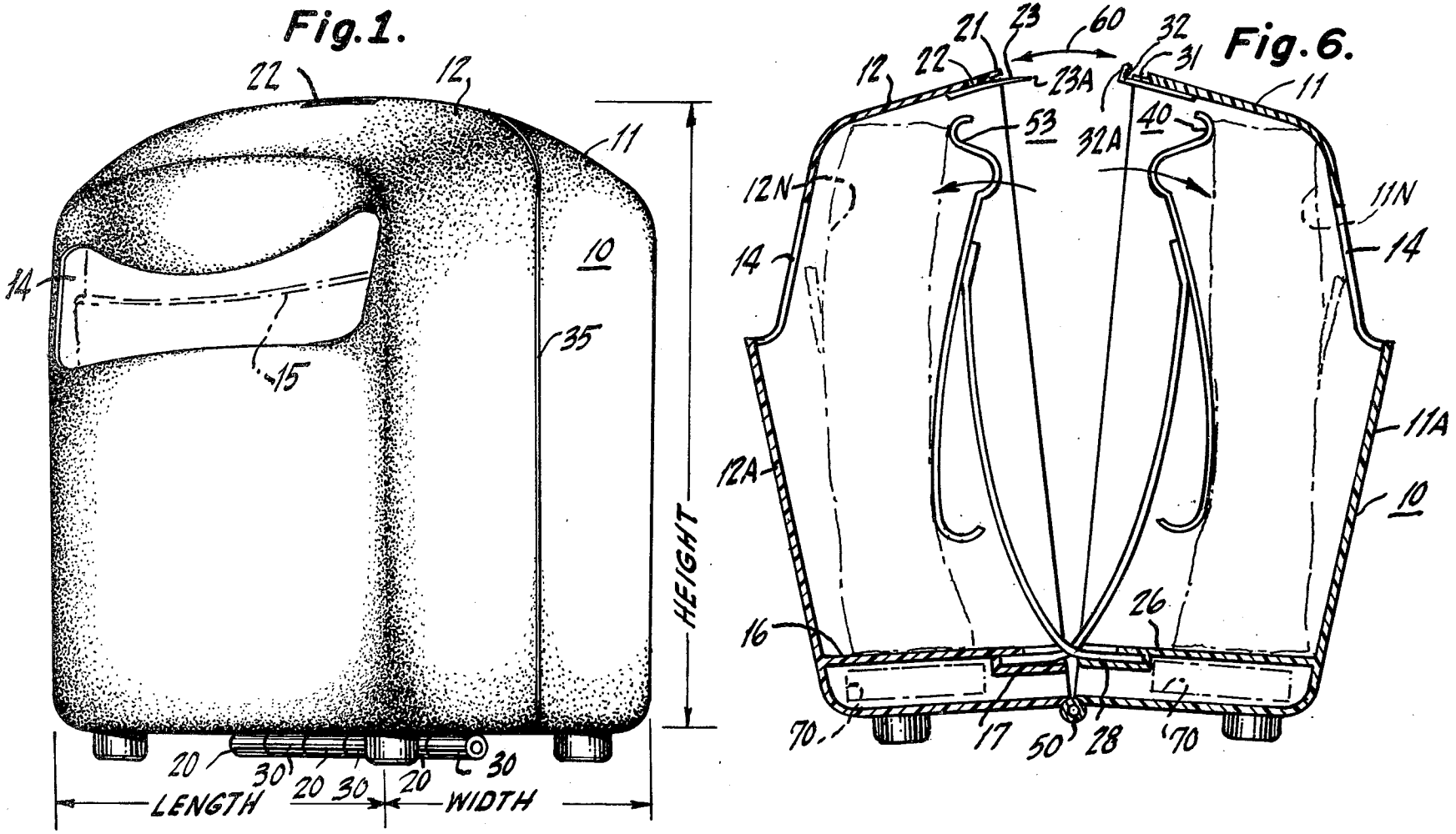
FIG. 1 is a perspective plan view of a napkin dispenser according to this invention.
FIG. 6 is a side view in diagrammatic form necessary to explain the operation of the dispenser.

Referring to FIG. 1, there is shown a perspective view of a typical napkin dispenser 10. Essentially, the dispenser 10 consists of two sections 11 and 12 which are joined together by means of a latch mechanism 13 and a hinge member located on the underside of the unit.

Each section as 11 and 12 has an opening 14 which permits a user to withdraw a napkin 15 from a stack of such napkins contained within the hollow of the dispenser 10.

The dispenser 10 conventionally has a plurality of legs 16; each located in a respective corner on the bottom surface to allow the dispenser to stand as shown.

Briefly, the device in FIG. 1 is entirely fabricated from plastic and thus each section as 11 and 12 may be molded and coupled together by means of a suitable hinge assembly to form the final dispenser 10.

Figure 2:
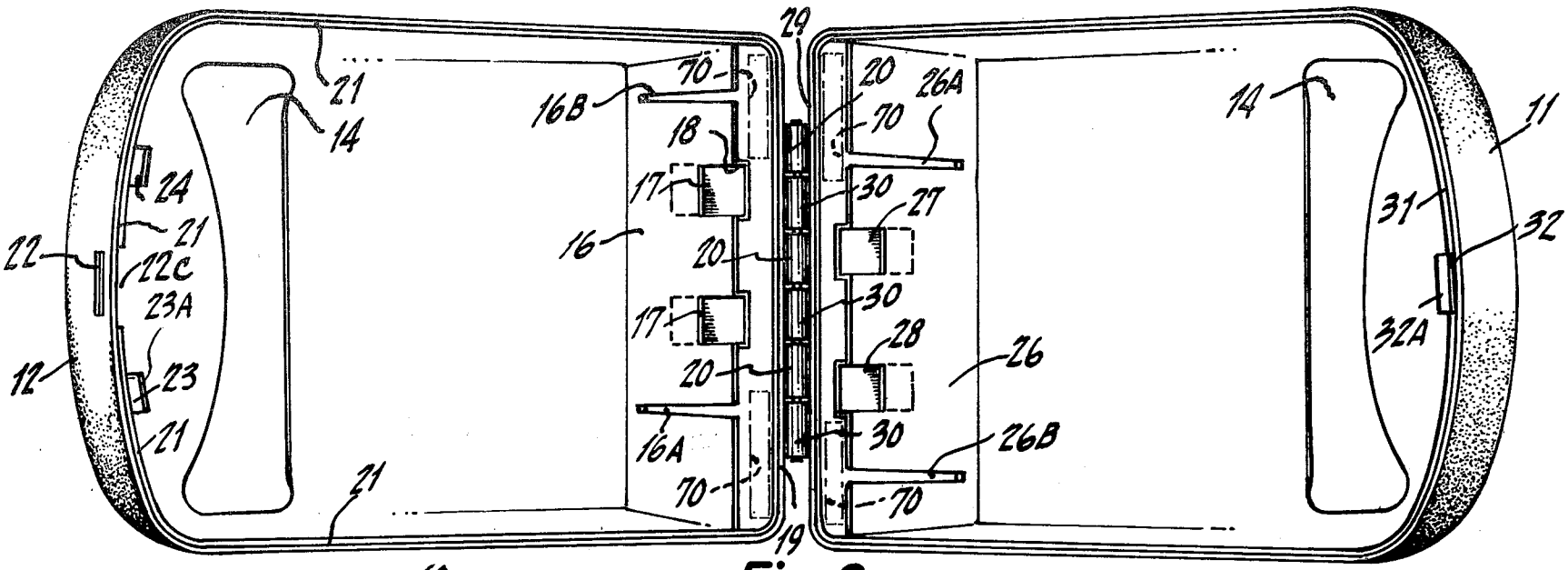
FIG. 2 is a perspective view depicting a left and a right section required to form the dispenser of FIG. 1.

Referring to FIG. 2, there is shown a perspective view of section 12 and section 11. It is noted as indicated above, that both sections have an opening as 14 to allow access to the napkins contained within the hollow. Each section as 11 and 12 is fabricated as an integral unit which is molded from a suitable plastic. There are many examples of commercial plastics presently available from which the sections 11 and 12 can be fabricated.

Essentially, the front of each section appears as that shown in FIG. 1 as section 12 and generally has the overall aesthetic appearance as shown.

For the sake of simplicity in explanation, the section 12 will be referred to as a female front section; while the section 11 will be referred to as the male section. The female section 12 has located near the bottom surface an internal platform or ridge 16 which extends in a horizontal plane and is located a ¼" or more above the bottom surface 19 of section 12. The ridge 16 is also part of the molded assembly and includes two adjacent channels 17 and 18 which are dimensioned to accommodate plastic spring retainer members as will be described.

The center portion of the platform 16 which contains the channels 17 and 18 are separated from the side walls of the section 12 by means of traverse slots 16A and 16B. Thus, the central portion of member 16 which contains channels 17 and 18 behaves as a cantilever structure or a spring structure and therefore can move as will be further explained, in the vertical plane. This action affords additional mechanical advantage to the spring assembly which is used to dispense the napkins.

The section 12 also has integrally formed therein a series of hinges 20 located on the bottom surface 17 of the female section 12. Located about the periphery of section 12 is an extending internally depending flange 21. Shown on the top surface of section 12 is a slot 22 which as will be explained, forms part of the latching mechanism.

Adjacent the slot 22 are two extending flange members 23 and 24. Each member is integrally formed with the section 12 and has an angled front end as 23A. The members 23 and 24 also serve as part of the latching mechanism.

Shown to the right of section 12 is the male section 11. The male section 11 also has an integral horizontal platform assembly 26 which is integrally formed during the molding process and is located the same distance above the bottom wall 29 of member 11. The platform 26 also has two corresponding channels 27 and 28 which, as will be explained, are dimensioned to accommodate respective ends of a plastic spring member. The channels 27 and 28 are offset with respect to the channels 17 and 18 to allow the arms of the spring members to pivot freely with respect to each other during operation of the mechanism.

Also shown located and integrally formed on section 11 are corresponding hinge assemblies 30. The hinge assemblies 30 are also offset with respect to the hinges 20 so that the hinge members 30 occupy the spaces between the hinged members 20 to form one continuous hinge assembly to secure the bottom surfaces 19 and 29 together; thus allowing the unit to pivot or to be opened about the hinge thus formed.

Located about the periphery of the male section 11 is an extending flange 31 which, as will be shown, fits into and is surrounded by the flange 21 associated with section 12. This therefore permits a relatively smooth surface appearance associated with the dispenser 10 at the juncture 35 between sections 11 and 12.

Also located on section 11 is an extending flange member 32 which has a front angle 32A adapted to fit into the slot 22 associated with the female section 12. Member 32 forms a part of the latching mechanism to be described.

Figure 3:
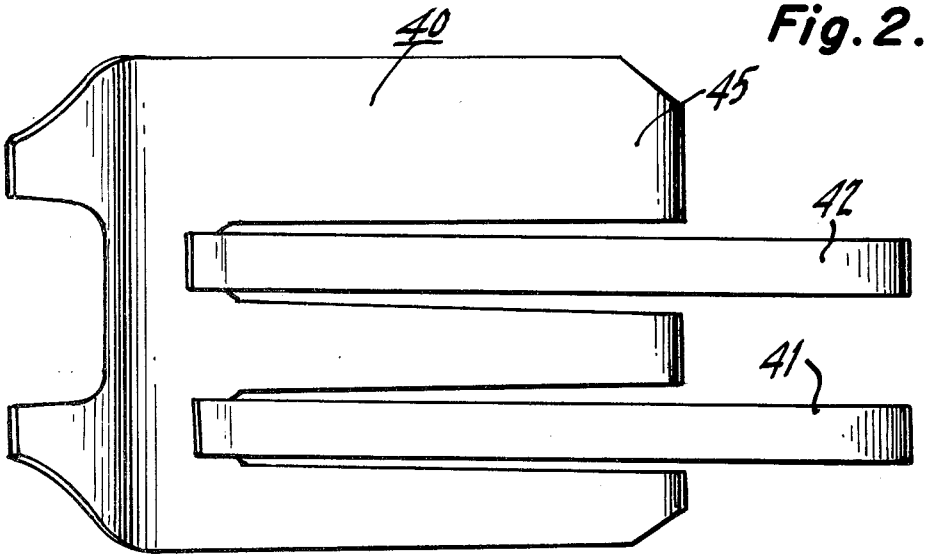
FIG. 3 is a front elevational view of a plastic spring assembly used in conjunction with the invention.

Shown in FIG. 3 is a plastic spring member 40. The member 40 is integrally formed and has two depending arms 41 and 42 which are inserted into the channels as 17 and 18 of section 12 and are glued or otherwise retained therein by means of a suitable adhesive or epoxy.

Figure 4:
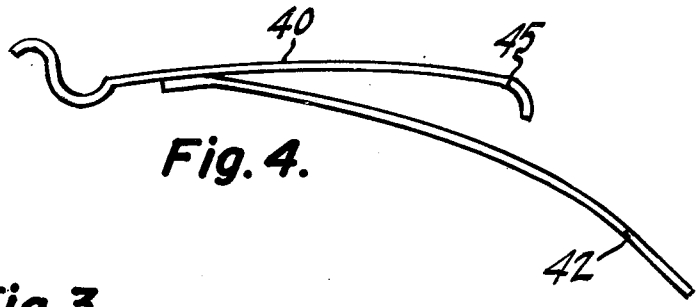
FIG. 4 is a side view of the spring assembly.

A side view of the member 40 is shown in FIG. 4. Essentially the depending arms 41 and 42 are arcuate and depend from the front surface 45 of the spring member 40. The surface 45, as will be explained, serves to hold a stack of napkins in position and to maintain a pressure on the stack to enable easy dispensing of the napkins from the holder.

A similar member as shown in FIG. 3 is also coupled to section 11 via channels 27 and 28. Essentially, the member associated with section 11 has the same appearance as that shown in FIG. 3, but has the depending arms as 41 and 42 offset in accordance with the location of channels 27 and 28 to allow the free movement of one section with respect to the other.

Figures 5, 7, 7A, 7B:
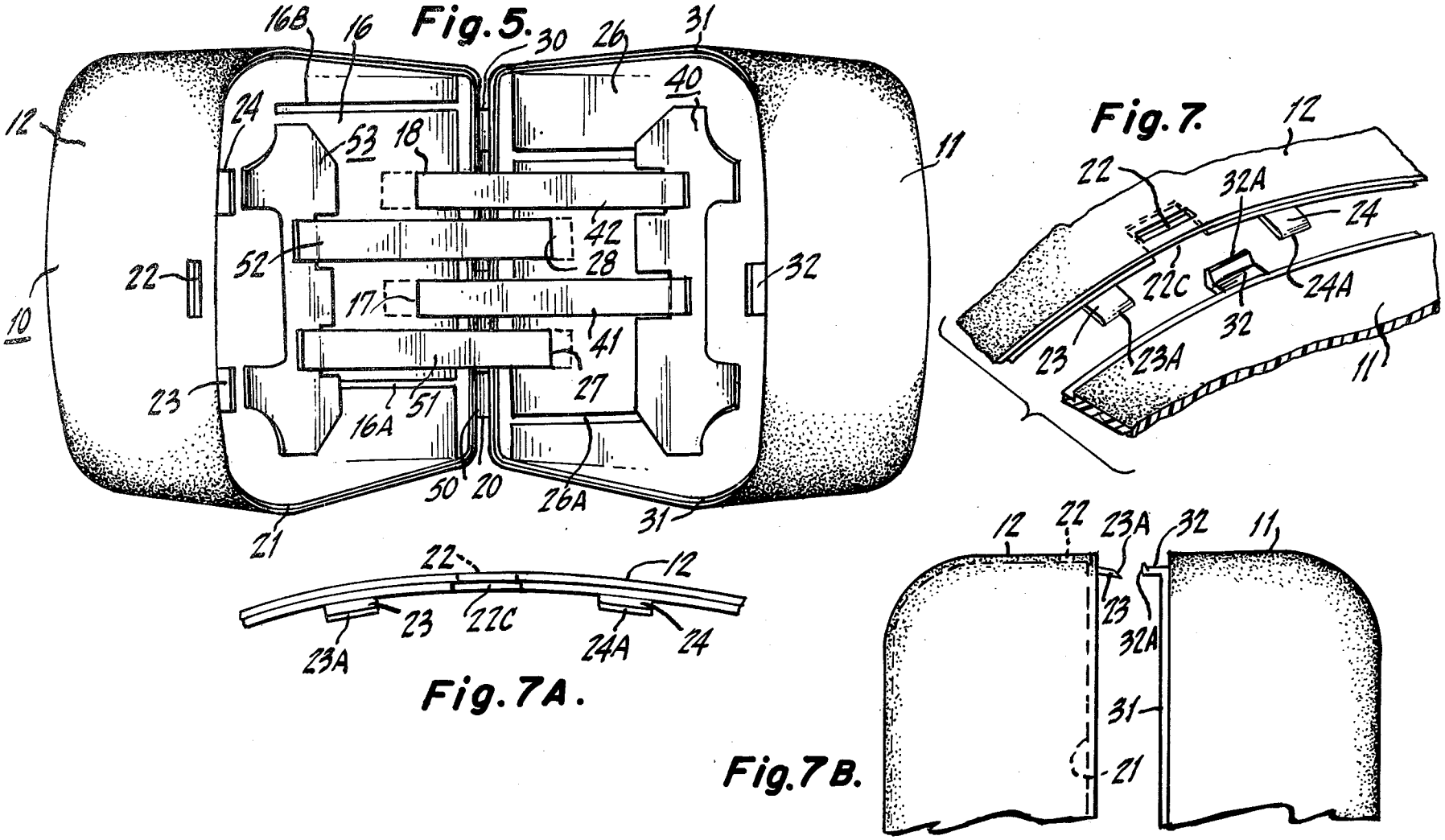

If reference is made to FIG. 5, there is shown the female section 12 coupled to the male section 11 by means of the hinge members 30 and 20 associated with the bottom surfaces of sections 11 and 12. Again, as previously described, the hinges 30 coact with the hinges 20 to form a single hinge to enable the pivoting of the sections. A metal rod or similar device is inserted through the apertures in the hinges to thus form a single unitary hinge 50.

FIG. 5 is a top view showing the dispenser 10 partially opened. As one can ascertain, the depending arms 41 and 42 of the plastic spring member 40 are inserted into apertures 17 and 18 associated with section 12. Similarly, the depending arms 51 and 52 are inserted into channels 27 and 28 associated with housing 11. The arms 51 and 52 are integrally formed with the spring surface member 53 which, as will be explained, urges a stack of napkins towards the napkin dispensing slot as 14 of FIG. 1 associated with each section. Thus, as is shown in FIG. 5, the depending arms 41 and 42 are adjacent arms 51 and 52 and hence, the spring members 20 and 53 may move with respect to each other and with respect to the sections 11 and 12.

As was previously indicated, the entire unit is fabricated from plastic with the exception that the rod which is associated with the hinge 50 may be fabricated from a suitable metal.

Referring to FIG. 6, there is shown a side schematic view of the dispenser 10 in order to explain operation. Essentially and as indicated, the sections 11 and 12 are pivotably connected by means of the hinge 50 and can therefore move in the direction of the arrow 60 with respect to one another. As the sections 11 and 12 are pivoted away from each other, the member 40 which is rigidly secured to section 12, moves towards the member 53 and member 53 moves towards member 40. Thus, when the unit is in a fully opened position where sections 11 and 12 are along the horizontal plane, members 40 and 53 are in contact and are positioned relatively perpendicular to the horizontal plane. Thus, in this opened position, a user can insert a stack of napkins as 12N and 11N within the hollow of the respective section located between the platform as 16 and 26 and the top surface of the section.

As one moves housing 11 towards housing 12 in order to align the same with the vertical plane or to close the dispenser, the member 40 is urged against the front wall 11A of section 11; while member 53 is urged against the front wall 12A of section 12.

Shown located within the hollow recess of each section is a respective stack of napkins 12N for section 12 and 11N for section 11. It can thus be seen for the closed position, the spring member 40 exerts a force upon the napkin stack 11N; while the spring member 53 exerts a similar force on the napkin stack 12N.

As previously indicated, the napkins in each stack communicate with a respective opening as 14 in each section and hence, one or more napkins can be removed via the opening 14 by a user. Due to the flexible nature of the plastic spring members 40 and 53, each time a napkin is removed from a respective section, the associated spring member moves towards the front wall as 11A and 12A of the respective section to thereby exert a suitable force on the remaining napkins in the associated stack and hence, to allow efficient dispensing of the same. It is also noted that one may deplete the entire stack as 11N in one section without changing the effective force exerted by the spring associated with the other section.

Hence, the mechanism described and as existed in a similar configuration in the metal unit described in the Background of the specification has great utility regarding the technique of dispensing napkins.

In any event, the plastic assembly thus described above has mechanical advantages over its metal counterpart while further adding ease of fabrication and thus economical advantages.

As was explained, each spring member as 40 and 53 and its depending arms as 41, 42 and 51 and 52 are rigidly secured to the center portion of the horizontal platform as 16 and 26. As indicated, this platform is secured at its back end to the front wall of the housing and in essence, forms a cantilever section to which the associated spring members are coupled. The cantilever section thus formed will also deflect as a function of the force exerted by the spring on the napkin stack to thus offer an additional force which further aids in providing a positive operation of the spring assemblies for the removal of the napkins.

Referring to FIG. 2, it is also seen that there is a space provided in each section as 11 and 12; which space is formed between the platform 16 for example and the bottom wall 19. Since the entire unit is fabricated from plastic, it is relatively light in weight compared to its metal counterpart and hence, in order to maintain greater stability, additional weights such as metal or plastic bars as 70 may be inserted and retained within the space formed between the platform 16 and the bottom wall 19 of the respective section; as 12 in this example. This further assures that the dispenser will be extremely stable as being much heavier near the bottom surface than at the top. This aspect, of course, is not provided in the metal counterparts and they tend to be heavy due to the metal fabrication, but the weight is uniformly distributed.

Referring to FIG. 7, there is shown a cross-sectional view of the particular latching mechanisms previously alluded to and which now will be more fully explained. As one can see from FIG. 7, one section as 11 has an extending flange member 32 which has a transverse arm 32A. The member 12, as indicated, has a slot 22 on the top surface located at the distance from the front which is approximately equal to the distance that the flange 32 extends from section 11. Located beneath the slot is a channel 22C. Essentially, when section 11 is pushed towards section 12, the flange 32 deflects downwardly until the transverse section 32A coacts with the slot 22. In this manner, the section 32A is then located within the slot 22 to secure section 12 to section 11. This type of clamp or latch is very well known and is used in many, many applications to secure two members to one another and used as a latch in both metal and plastic housing configurations. In any event, the action of a latch which solely consists of a slot as 22 and a latching flange 32 is not a positive or secure enough structure for the present purposes.

As indicated, both sections 11 and 12 are fabricated from plastic and as such, the length of the top of the housing may be approximately ten centimeters, the height of the housing may be approximately fourteen centimeters, while the width of the housing is approximately twelve centimeters. The arrows associated with these dimensions are shown in FIG. 1.

The use of the latch member which solely comprises the slot 22 and the flange 32 enables the coupling of section 11 to section 12, but does not provide a secure enough action. In such dispensers as 10 for use in restaurants or other commercial establishments, it is desireable to couple the sections relatively secure to thus prevent accidental opening during normal use. In this manner, adjacent the slot 22 and located on section 12 as explained, are two extending flange members 23 and 24. Each member has an angled front section as 23A and 24A. The relationship of the members are further shown in FIG. 7A with respect to the slot 22 and associated with channel 22C.

The members 23 and 24 function to exert an upward force on section 11 about the flange 32 when the arm 32A is in the slot. This force imparts an additional mechanical advantage which tends to push and maintain the arm 32A of the flange 32 in the slot 22.

As indicated and shown in FIG. 7B, the housing section 11 has an extending flange 31 associated therewith, while the housing section 12 has a depending flange 21 associated therewith. Thus, when housing 11 is coacting with housing 12, the flange 31 is inserted into flange 21 to provide a smooth closure line as 35 of FIG. 1.

As shown in FIG. 7B, the extending arm 22 of section 12 underlies the flange 31 and exerts an upward force about the latching flange 32; which force firmly secures the arm 32A within the slot 22. In order to open the mechanism, one would therefore exert a relatively substantial force sufficient to push the member 32 downwardly to release the arm 32A from the slot 22. The nature of the latch action is such that if one is not apprised of the mechanism, it would be extremely difficult to open.

Thus, there has been described a dispenser for napkins which is entirely fabricated from plastic and which possesses features enabling the same to operate more reliably than metal dispensers which are provided according to similar principles. The plastic dispenser thus described has provisions for adding additional weight without interfering or in any manner affecting the placement of the napkins, while further providing extra mechanical advantage to plastic spring members by coupling the same to a cantilever platform integrally formed during an injection molding process and providing a positive latching operation when the sections are coupled together.

The unit, as described, can be fabricated by conventional techniques extensively used in the plastic industry such as injection molding and hence, the basic structure can be simply and easily produced in great quantities, while eliminating many steps in fabrication as necessary to provide a metal counterpart. The use of plastic obviously avoids the above described problems concerning rust and sanitary conditions which are inherent in prior art metal dispensers.

I claim:

1. In a napkin dispenser apparatus of the type including a first and a second hollow housing, each having a front wall containing an aperture for accessing a stack of napkins associated and contained within said hollow of each housing, said front wall surrounded by two side walls and a top and a bottom wall with an opened rear surface, said first and second housing pivotally coupled at said bottom walls with said opened rear surfaces facing each other, the improvement therein comprising:

a. a first cantilever platform located a predetermined distance from said bottom wall of said first housing and horizontally disposed between said side walls of said first housing, said first platform including at least one channel located on a surface thereof in a predetermined position, b. a second cantilever platform located said predetermined distance from said bottom wall of said second housing and horizontally disposed between said side wall of said second housing, said second platform including at least one channel located on a surface thereof in a position offset from said predetermined position, c. a first arcuate spring member secured to said first platform and positioned to extend into said second housing to exert a force on said stack of napkins associated with said second housing, means coupling one end of said first spring member to said channel on said first platform, d. a second arcuate spring member secured to said second platform and positioned to extend into said first housing to exert a force on said stack of napkins associated with said first housing, with each of said cantilever platforms capable of deflecting to aid in maintaining said force as exerted by said spring member, means coupling one end of said second spring member to said channel on said second platform, whereby said first and second spring members can move with respect to one another when said housings are pivoted.

2. The napkin dispenser according to claim 1 further including at least one weight member positioned in the hollow between said platform and said bottom wall of said housings.

3. The napkin dispenser according to claim 1 including latching means for securing said first housing to said second housing.

4. The napkin dispenser according to claim 3 wherein said latching means comprises said top wall of said first housing including a slot relatively centrally located, a first extending flange adjacent said slot at one side thereof, a second extending flange adjacent said slot at another side, said second section including an extending latching flange having a transversely extending front portion positioned on said second housing to coact with and engage said slot when said first housing is coacting with said second housing with said front portion of said latching flange located in said slot, and said first and second extending flanges coacting with the bottom surface of said top wall of said second housing to exert an upward force on said latching flange to firmly engage said front portion in said slot.

5. The apparatus according to claim 1 wherein said first arcuate spring member comprises a relatively flat front wall having integrally formed therewith at least one arcuate arm fabricated from a flexible spring material, said arm directed away from said front wall along a given arcuate path with the remote end of said arm coupled within said channel of said first platform.

6. The apparatus according to claim 5 wherein said first arcuate spring member is integrally formed from a flexible plastic.

7. The apparatus according to claim 1 wherein said first and second housings and said first and second spring members are fabricated from plastic.

8. The napkin dispenser according to claim 1 wherein said first platform is integrally formed with said first housing and said second platform is integrally formed with said second housing.

9. The napkin dispenser according to claim 5 wherein said arm of said spring member is glued within said channel of said first platform.

* * * * *